US006632514B1

(12) United States Patent
Sulin et al.

(10) Patent No.: US 6,632,514 B1
(45) Date of Patent: Oct. 14, 2003

(54) COATED CUTTING INSERT FOR MILLING AND TURNING APPLICATIONS

(75) Inventors: Anette Sulin, Fagersta (SE); Rolf Olofsson, Fagersta (SE); Sakari Ruppi, Fagersta (SE); Jan Qvick, Virsbo (SE)

(73) Assignee: Seco Tools AB, Fagersta (SE)

( * ) Notice: Subject to any disclaimer, the term of this patent is extended or adjusted under 35 U.S.C. 154(b) by 83 days.

(21) Appl. No.: 09/717,006

(22) Filed: Nov. 22, 2000

(30) Foreign Application Priority Data

Nov. 25, 1999 (SE) ..... 99042474
Feb. 29, 2000 (SE) ..... 0000667

(51) Int. Cl.[7] ..... B32B 9/00

(52) U.S. Cl. ..... 428/216; 51/295; 51/307; 51/309; 428/336; 428/472; 428/697; 428/698; 428/699; 428/701

(58) Field of Search ..... 428/216, 336, 428/472, 465, 697, 658, 699, 701, 702; 51/307, 309, 295; 407/119

(56) References Cited

U.S. PATENT DOCUMENTS

RE31,526 E * 2/1984 Smith et al.
4,984,940 A 1/1991 Bryant
5,543,176 A * 8/1996 Chatfield et al.
5,652,045 A * 7/1997 Nakamura et al.
5,700,569 A 12/1997 Ruppi
5,786,069 A * 7/1998 Ljungberg et al.
5,879,823 A * 3/1999 Prizzi et al.
5,902,671 A * 5/1999 Kutscher
5,920,760 A * 7/1999 Yoshimura et al.
6,015,614 A 1/2000 Ruppi
6,183,846 B1 * 2/2001 Moriguchi et al.
6,221,469 B1 * 4/2001 Ruppi
6,224,968 B1 * 5/2001 Van Den Berg et al.
6,261,673 B1 * 7/2001 Reineck et al.
6,333,099 B1 * 12/2001 Strondl et al.

FOREIGN PATENT DOCUMENTS

WO 9720081 6/1997
WO 9720082 6/1997
WO 9720083 6/1997

* cited by examiner

*Primary Examiner*—Archene Turner
(74) *Attorney, Agent, or Firm*—Burns, Doane, Swecker & Mathis, L.L.P.

(57) ABSTRACT

A cutting tool insert particularly useful for wet and dry milling of low and medium alloyed steels and stainless steels includes a cemented carbide body with a coating consisting of an MTCVD Ti(C,N) layer and a multi-layer coating being composed of κ-$Al_2O_3$ and TiN or Ti(C,N) layers.

17 Claims, 1 Drawing Sheet

COATED CUTTING INSERT FOR MILLING AND TURNING APPLICATIONS

FIELD OF THE INVENTION

The present invention relates to a coated cemented carbide insert (cutting tool) particularly useful for wet and dry milling of low and medium alloyed steels and stainless steels. It is also excellent for turning of stainless steels.

BACKGROUND OF THE INVENTION

When machining low and medium alloyed steels and stainless steels with cemented carbide tools, the cutting edge is worn according to different wear mechanisms, such as chemical wear, abrasive wear, adhesive wear and by edge chipping caused by cracks formed along the cutting edge.

During milling, which is an intermittent cutting process, the cutting edge is exposed to thermal variations that cause the thermal cracks mentioned above. These cracks will finally destroy the cutting edge.

During turning, which can either be a continuous or an intermittent cutting process, the cutting edge is exposed to variations in cutting forces and thermal variations that cause the cracks mentioned above. These cracks will finally destroy the cutting edge.

Measures can be taken to improve the cutting performance with respect to a specific wear type. However, very often such action will have a negative effect on other wear properties. The following has generally been accepted:

Thermal crack formation may be reduced by lowering the binder phase content. This measure will, however, also reduce the toughness properties of the cutting insert which is generally not desirable, The toughness may be improved by increasing the binder phase content. However, this measure will decrease the plastic deformation resistance and in general increase the abrasive wear and the formation of thermal cracks.

The deformation resistance may be increased by reducing the grain size of the carbide phase. However, this measure has a negative effect on the crack initiation and propagation which gives rise to edge chipping.

An alternative way to increase the deformation resistance is to add cubic carbides like TiC, TaC and/or NbC. This will, in general, also increase the wear resistance when machining at high cutting edge temperatures. However, this addition also has a negative influence on the formation of thermal cracks and edge chipping.

So far it has been very difficult to improve all tool properties simultaneously. Commercial cemented carbide grades have therefore been optimized with respect to one or few of the above mentioned wear types and consequently also to specific application areas.

WO 97/20083 discloses a coated cutting insert particularly useful for milling of low and medium alloyed steels and stainless steels with raw surfaces such as a cast skin, forged skin, hot or cold rolled skin or pre-machined surfaces under unstable conditions. The insert is characterized by a WC-Co cemented carbide with a low content of cubic carbides and a rather low W-alloyed binder phase and a coating including an innermost layer of $TiC_xN_yO_z$ with columnar grains and a top layer of TiN and an inner layer of $\kappa$-$Al_2O_3$.

WO 97/20081 describes a coated milling insert particularly useful for milling in low and medium alloyed steels with or without raw surface zones during wet or dry conditions. The insert is characterized by a WC-Co cemented carbide with a low content of cubic carbides and a highly W-alloyed binder phase and a coating including an inner layer of $TiC_xN_yO_z$ with columnar grains, an inner layer of $\kappa$-$Al_2O_3$ and, preferably, a top layer of TiN.

WO 97/20082 discloses a coated turning insert particularly useful for turning in stainless steel. The insert is characterized by a WC-Co-based cemented carbide substrate having a highly W-alloyed Co-binder phase and a coating including an inner layer of $TiC_xN_yO_z$, with columnar grains followed by a layer of fine grained $\kappa$-$Al_2O_3$ and a top layer of TiN.

U.S. Pat. No. 5,700,569 discloses an alumina coated cemented carbide insert having improved properties for metal cutting applications. The insert has six to eight layers of alumina with a total coating thickness of up to about 15 $\mu$m.

U.S. Pat. No. 4,984,940 discloses an indexable metal cutting insert having a cobalt cemented tungsten carbide substrate with a multi-layer refractory coating thereon. The substrate has a cobalt content of 6.1 to 6.5 weight percent. The coating contains at least a plurality of alumina layers which are separated from and bonded to each other by a group IVB metal nitride, such as titanium nitride, and which are bonded to the substrate by a backing layer of 5 to 8 $\mu$m in thickness, composed of a carbide and/or carbonitride of titanium, zirconium and/or hafnium.

U.S. Pat. No. 6,015,614 discloses an $Al_2O_3$—TiN coated cemented carbide insert intended for turning of steels and especially Ca-treated steels. The alumina layer is protected by an extra thick and multilayered coating of TiN.

SUMMARY OF THE INVENTION

It has now been found that enhanced milling and turning performance can be obtained by combining the substrate and the multi-layer coating of the present invention. The cutting insert has excellent performance in low and medium alloyed steel but particularly in stainless steel. The cutting tool displays an improved behavior with respect to many of the wear types mentioned earlier, in particular to formation of edge chipping caused cracks along the cutting edge.

According to one aspect, the present invention provides a cutting tool insert comprising a cemented carbide body and a coating, said coating including a multi-layer coating with a total thickness varying from 2 $\mu$m to 20 $\mu$m, said coating being composed of $\kappa$-$Al_2O_3$ layers with a thickness of 0.1–0.4 $\mu$m, and TiN or Ti(C,N) layers with a thickness of 0.3 to 0.6 $\mu$m; and that said cemented carbide body comprising WC with a mean intercept length of 0.5–0.9 $\mu$m, 9.0–10.9 wt-% Co and 0.5–2.5 wt-% TaC+NbC with a ratio of the weight concentrations of Ta and Nb 7.0–12.0, and a binder phase with an S-value of 0.81–0.92.

DETAILED DESCRIPTION OF THE INVENTION

Figure 1:
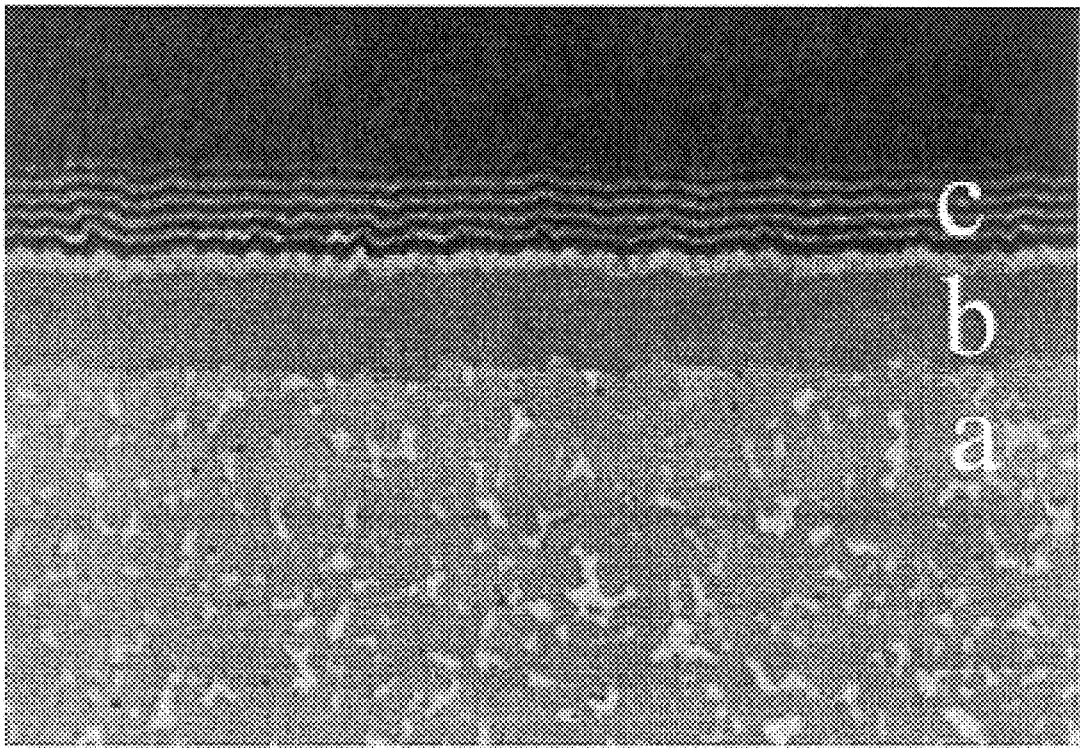
FIG. 1 is a micro graph in 5000X magnification of a coated insert according to the present invention.

Generally, the following features are illustrated in FIG. 1:

a—substrate;

b—MTCVD coating with columnar grains; and c—multi-layer coating.

The cutting tool insert according to the present invention includes: a cemented carbide substrate with a relatively low amount of cubic carbides, with a medium to highly W-alloyed binder phase and with a fine to medium grain size. This substrate is provided with a coating, preferably of b and c specified above.

According to the present invention a coated cutting tool insert is provided with a cemented carbide body having a composition of 9.0–10.9 wt-% Co, preferably 9.5–10.7 wt-% Co, most preferably 9.9–10.5 wt-% Co; 0.5–2.5 wt-%, preferably 1.0–2.0 wt-%, most preferably 1.2–1.8 wt-% total amount cubic carbides of the metals Ti, Nb and Ta and balance WC. Ti, Ta and/or Nb may also be replaced by other carbides of elements from groups IVb, Vb or VIb of the periodic table. The content of Ti is preferably on a level corresponding to a technical impurity. In a preferred embodiment, the ratio between the weight concentrations of Ta and Nb is within 7.0–12.0, preferably 7.6–11.4, most preferably 8.2–10.5.

In an alternative preferred embodiment, the ratio between the weight concentrations of Ta and Nb is within 1.0–5.0, preferably 1.5–4.5.

The cobalt binder phase is medium to highly alloyed with tungsten. The content of W in the binder phase may be expressed as the S-value=$\sigma/16.1$, where $\sigma$ is the measured magnetic moment of the binder phase in $\mu Tm^3kg^{-1}$. The S-value depends on the content of tungsten in the binder phase and increases with a decreasing tungsten content. Thus, for pure cobalt, or a binder that is saturated with carbon, S=1 and for a binder phase that contains W in an amount that corresponds to the borderline to formation of $\eta$-phase, S=0.78.

It has now been found according to the present invention that improved cutting performance is achieved if the cemented carbide body has an S-value within the range 0.81–0.92, preferably 0.82–0.90, most preferably 0.85–0.89.

Furthermore the mean intercept length of the tungsten carbide phase measured on a ground and polished representative cross section is in the range 0.5–0.9 $\mu$m, preferably 0.6–0.8 $\mu$m. The intercept length is measured by means of image analysis on pictures with a magnification of 10000× and calculated as the average mean value of approximately 1000 intercept lengths.

The coating according to a preferred embodiment, includes an inner 2–8 $\mu$m, preferably 3 $\mu$m, layer of MTCVD Ti(C,N), and a $\kappa$-$Al_2O_3$—TiN/Ti(C,N) multi-layer coating.

For enhanced adhesion between the layers, the MTCVD layer (b) and the TiN or Ti(C,N) layers in (c) may be terminated by one or several of the following CVD-layers: TiN, TiC, Ti(C,O), or (Ti,Al) (C,O), having a thickness of 0.5–2 $\mu$m, preferably 1 $\mu$m.

The multi-layer coating is composed of alternating CVD carbon-doped TiN layers (containing preferably less than 5% total carbon) or MTCVD Ti(C,N) and thin $\kappa$-$Al_2O_3$ layers. The thickness of the $\kappa$-$Al_2O_3$ layers is 0.1–0.4 $\mu$m, preferably 0.2–0.3 $\mu$m and the thickness of the TiN or Ti(C,N) layers is 0.3–0.6 $\mu$m, preferably about 0.4 $\mu$m. The first and the last layer in the multi-layer coating is a $\kappa$-$Al_2O_3$ layer. A TiN layer <1 $\mu$m may be deposited atop the uppermost $\kappa$-$Al_2O_3$ layer. The total thickness of the multi-layer coating can be from 2 $\mu$m (total: approximately seven individual layers) to 20 $\mu$m (total: approximately 41 individual layers). The thinner coating is preferred in applications where extreme toughness is required. The thicker coating is for applications where high wear resistance is needed.

In a preferred embodiment, the multi-layer coating thickness should be from 2 to 8 $\mu$m, preferably from 2.5 to 6 $\mu$m being composed of 3–6 carbon doped TiN layers and 4–7 $\kappa$-$Al_2O_3$ layers.

The present invention also relates to a method of making a coated cutting tool including providing a body or substrate with a composition of: 9.0–10.9 wt-%, preferably 9.5–10.7 wt-%, most preferably 9.9–10.5 wt-% Co; 0.5–2.5 wt-%, preferably 1.0–2.0 wt-%, most preferably 1.2–1.8 wt-% total amount cubic carbides of the metals Ti, Nb and Ta; and balance WC. Ti, Ta and/or Nb may also be replaced by other carbides of elements from groups IVb, Vb or VIb of the periodic table. The content of Ti is preferably on a level corresponding to a technical impurity. In a preferred embodiment, the ratio between the weight concentrations of Ta and Nb is within 7.0–12.0, preferably 7.6–11.4, most preferably 8.2–10.5.

In an alternative preferred embodiment, the ratio between the weight concentrations of Ta and Nb is within 1.0–5.0, preferably 1.5–4.5.

The desired mean intercept length depends on the grain size of the starting powders and milling and sintering conditions and has to be determined by experiments. The desired S-value depends an the starting powders and sintering conditions and also has to be determined by experiments.

A first layer of Ti(C,N) is deposited with MTCVD-technique onto the cemented carbide using acetonitrile as the carbon and nitrogen source for forming the layer in the temperature range of 700–900° C.

A CVD-layer according to the description above is subsequently deposited on top of this layer and is followed by a multi-layer coating consisting of alternating layers of $\kappa$-$Al_2O_3$ and carbon doped TiN or MTCVD-Ti(C,N). The alumina layer is deposited according to known technique. The carbon doped TiN-layer is deposited according to known technique.

The present invention will now be further explained by reference to the following illustrative examples.

EXAMPLES

The following substrate-coating combinations were selected to be used as examples to demonstrate the invention in more detail:

| Grade | Substrate | Coating |
|---|---|---|
| I | A (invention) | X (prior art) |
| II | B (invention) | X (prior art) |
| III | A (invention) | Y (invention) |
| IV | A (invention) | Z (prior art) |

Substrate A: A cemented carbide substrate in accordance with the invention with the composition 10.2 wt-% Co, 1.35 wt-% TaC, 0.15 wt-% NbC and balance WC, with a binder phase alloyed with W corresponding to an S-value of 0.87 was produced by conventional milling of the powders, pressing of green compacts and subsequent sintering at 1430° C. Investigation of the microstructure after sintering showed that the mean intercept length of the tungsten carbide phase was 0.7 $\mu$m. After sintering, the inserts were ground and honed.

Substrate B: A cemented carbide substrate in accordance with the invention with the composition 9.7 wt-% Co, 1.35 wt-% TaC and 0.15 wt-% NbC and balance WC, with a binder phase alloyed with W corresponding to an S-value of 0.89 was produced in a manner similar to substrate A above. The microstructure of the insert displayed a mean intercept length of the tungsten carbide phase of 0.8 $\mu$m.

Coating X (prior art): 5 $\mu$m MTCVD Ti(C,N) and a single 1 $\mu$m $\kappa$-$Al_2O_3$ top layer.

Coating Y (invention): 3 μm MTCVD Ti(C,N) and a 3 μm multi-layer coating of four carbon doped TiN layers and five κ-$Al_2O_3$ layers, FIG. 1. This layer was deposited using a conventional technique.

Coating Z (prior art): 3 μm Ti(C,N) layer and a 3 μm multi-layer coating of four κ-$Al_2O_3$ and five TiN layers, where κ-$Al_2O_3$ dominates, according to the prior art. The κ-$Al_2O_3$ layers had a thickness of 0.7 μm. This coating was deposited according to U.S. Patent No. 5,700,569 and U.S. Patent No. 5,137,774.

Example 1

Comparative Grade V. (prior art) A cemented carbide insert with the composition 9 wt-% Co, 0.45 wt-% TaC, 0.05 wt-% NbC, and balance WC and an S-value of 0.98, and with a sintered mean intercept length for the tungsten carbide phase of 1.2 μm. The coating of the insert was a conventional CVD-coating consisting of Ti(C,N)+TiC+TiN with a total thickness 5.0 μm.

Operation: Face milling, cutter diameter 125 mm

Work piece: Bar, 600 mm×70 mm

Material: SS2344

Insert type: SEKN1203AFTN

Cutting speed: 200 m/min

Feed: 0.2 mm/tooth

Depth of cut: 2.5 mm

Width of cut: 70 mm

Remarks: Single tooth milling, wet milling.

Results: Tool life (min):

| | | |
|---|---|---|
| Grade I | 47 | (substrate acc. to invention) |
| Grade II | 40 | (substrate acc. to invention) |
| Grade V | 24 | (prior art) |

Tool life-criterion was destruction of the cutting edge due to thermal crack propagation. The test result shows that the cemented carbide substrate according to the invention exhibited longer tool life than the comparative prior art grade.

Example 2

Comparative Grade VI. (Prior art) A cemented carbide insert from a competitor was selected for comparison in a turning test. The carbide had a composition of 9.0 wt-% Co, 1.8 wt-% TaC, 0.2 wt-% NbC, and balance WC. The coating of the insert consisted of TiC+TiN+TiC+TiN with a total thickness of 4.0 μm.

Operation: Face turning

Work piece: Cylindrical Bar

Material: SS2333

Insert type: CNMG120408

Cutting speed: 150 m/min

Feed: 0.2 mm/rev

Depth of cut: 2.5 mm

Remarks: wet turning.

Results: Tool life (min)

| | | |
|---|---|---|
| Grade I | 14.5 | (substrate acc. to invention) |
| Grade II | 13.7 | (substrate acc. to invention) |

-continued

| | | |
|---|---|---|
| Grade V | 11.3 | (prior art) |
| Grade VI | 12.5 | (prior art) |

Tool life criterion was destruction of the cutting edge due to edge chipping. The test result shows that the cemented carbide substrate according to the invention exhibited longer tool life than the prior art grade.

Example 3

Comparative Grade VII. (Prior art) A cemented carbide insert from a competitor was selected for comparison in a milling test. The carbide had a composition of 9.2 wt-% Co, 0.1 wt-% TiC, 1.3 wt-% TaC and 0.3 wt-% NbC balance WC. The coating of the insert consisted of Ti(C,N)+$Al_2O_3$+TiN with a total thickness of 5.9 μm.

Comparative Grade VIII. (Prior art) A cemented carbide insert from a comparative competitor was selected for comparison in a milling test. The carbide had a composition of 11.5 wt-% Co, 0.3 wt-% TiC, 1.3 wt-% TaC, 0.3 wt-% NbC, and balance WC. The coating of the insert consisted of Ti(C,N)+$Al_2O_3$+TiN with a total thickness of 6.5 μm.

Operation: Face milling

Work piece: Bar, 600 mm×26 mm

Material: SS2344

Insert type: SEKN1203AFTN

Cutting speed: 200 m/min

Feed: 0.2 mm/tooth

Depth of cut: 2.5 mm

Width of cut: 26 mm

Remarks: Single tooth milling, wet milling.

Results: Tool life (min):

| | | |
|---|---|---|
| Grade I | 30 | (substrate acc. to invention) |
| Grade VII | 20 | (prior art) |
| Grade VIII | 26 | (prior art) |

Tool life criterion was destruction of the cutting edge due to thermal and mechanical crack propagation. In this test the all coatings were of similar type and the difference was principally between the constitution of the cemented carbide. The test results show that the cemented carbide substrate according to the invention exhibited longer tool life than two important competitor grades containing less and more binder phase respectively.

Example 4

Operation: Face milling

Work piece: Bar, 600 mm×70 mm

Material: SS2541

Insert type: SEKN1203AFTN

Cutting speed: 300 m/min

Feed: 0.2 mm/tooth

Depth of cut: 2.5 mm

Width of cut: 70 mm

Remarks: Single tooth milling, dry milling

Results: Tool life (min):

| | | |
|---|---|---|
| Grade I | 19 | (substrate acc. to invention) |
| Grade III | 28 | (invention) |
| Grade IV | 23 | (substrate acc. to invention) |

Tool life criterion was flank wear in combination with thermal crack propagation. The test results show that the cemented carbide tool according to the invention exhibited longer tool life than the same substrate coated with two different types of coatings according to prior art.

Example 5

Operation: Face milling
Work piece: Cast part for air plane
Material: SS2377, 1400 MPa
Insert type: SEKN1504AFTN
Cutting speed: 80 m/min
Feed: 0.16 mm/tooth
Depth of cut: 6 mm
Width of cut: max 200 mm
Remarks: Wet milling
Results: Tool life (min):

| | | |
|---|---|---|
| Grade I | 68 | (substrate acc. to invention) |
| Grade III | 100 | (invention) |
| Grade IV | 75 | (substrate acc. to invention) |

Tool life criterion was surface finish of the work piece. The test results show that the cemented carbide tool according to the invention exhibited longer tool life than both a prior art grade and a cemented carbide tool with a substrate according to the invention with a prior art coating.

Example 6

Comparative Grade IX. (Prior art) A cemented carbide insert from a competitor was selected for comparison in a turning test. The carbide had a composition of 10.5 wt-% Co, 1.3 wt-% TaC, 0.3 wt-% NbC, and balance WC. The coating of the insert consisted of Ti(C,N)+$Al_2O_3$+TiN with a total thickness of 6.0 $\mu$m.

Operation: Turning, with repeated short time engagement (15 seconds)
Work piece: Cylindrical Bar
Material: SS2343
Insert type: CNMG120408
Cutting speed: 180 m/min
Feed: 0.3 mm/rev
Depth of cut: 1.5 mm
Remarks: Dry turning.
Results: Tool life (min)

| | | |
|---|---|---|
| Grade III | 13.8 | (invention) |
| Grade IV | 12.5 | (substrate acc. to invention) |
| Grade IX | 12 | (prior art) |

Tool life criterion was destruction of the cutting edge due to edge chipping and notch wear at the cutting depth. The test results show that the cemented carbide tool according to the invention exhibited longer tool life than the same substrate coated with different type of coating according to prior art and the important competitors grade.

Example 7

Operation: Turning, with repeated short time engagement (2–10 seconds)
Work piece: Cylindrical Bar
Material: SS2343
Insert type: CNMG120408
Cutting speed: 200 m/min
Feed: 0.2 mm/rev
Depth of cut: 2.5 mm
Remarks: Wet turning.
Results: Tool life (min)

| | | |
|---|---|---|
| Grade III | 11 | (invention) |
| Grade VI | 8.5 | (prior art) |
| Grade IX | 10 | (prior art) |

Tool life criterion was flank wear in combination with edge chipping. The test results show that the cemented carbide tool according to the invention exhibited longer tool life than the two important competitors.

Example 8

Operation: Turning copying
Work piece: Cast part
Material: SS2352
Insert type: TNMG160408
Cutting speed: 180 m/min
Feed: 0.2 mm/rev
Depth of cut: 0.85–4 mm
Remarks: Wet turning
Results: Tool life (min)

| | | |
|---|---|---|
| Grade I | 24 | (substrate acc. to invention) |
| Grade III | 28 | (invention) |
| Grade IX | 20 | (prior art) |

Tool life criterion was surface finish on the work piece. The test results show that the cemented carbide tool according to the invention exhibited longer tool life than both a cemented carbide tool with a substrate according to the invention with a prior art coating and an important competitor grade.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cutting tool insert comprising a cemented carbide body and a coating, said coating includes a multi-layer coating with a total thickness varying from 2 $\mu$m to 20 $\mu$m, said coating being composed of $\kappa$-$Al_2O_3$ layers with a thickness of 0.1–0.4 $\mu$m, and TiN or Ti(C,N) layers with a thickness of 0.3 to 0.6 $\mu$m; and that said cemented carbide body comprising WC with a mean intercept length of 0.5–0.9 μm, 9.0–10.9 wt-% Co and 0.5–2.5 wt-% TaC+NbC with a ratio of the weight concentrations of Ta and Nb of 7.0–12.0, and a binder phase with an S-value of 0.81–0.92.

2. The cutting tool insert according to claim 1, wherein the thickness of the multi-layer coating is from 2 to 8 μm, and comprises 3–6 carbon doped TiN layers and 4–7 κ-$Al_2O_3$ layers.

3. The cutting tool insert according to claim 1, wherein the multi-layer coating comprises approximately 7–41 individual layers.

4. The cutting tool insert according to claim 1, wherein the κ-$Al_2O_3$ layers have a thickness of 0.2–0.3 μm.

5. The cutting tool insert according to claim 1, wherein the mean intercept length is 0.6–0.8 μm.

6. The cutting tool insert according to claim 1, wherein the body comprises 9.5–10.7 wt.-% Co.

7. The cutting tool insert according to claim 1, wherein the body comprises 1.0–2.0 wt.-% TaC+NbC, and a ratio of weight concentration of Ta and Nb is 7.6–11.4.

8. The cutting tool insert according to claim 2, wherein the S-value is 0.82–0.90.

9. The cutting tool insert according to claim 2, wherein the thickness of the multi-layer coating is 2.5–6.0 μm.

10. The cutting tool insert according to claim 1, further comprising a bonding layer between the κ-$Al_2O_3$ layers and the TiN or Ti(C,N) layers.

11. The cutting tool insert according to claim 10, wherein the bonding layer has a thickness of 0.5–2.0 μm and comprises at least one of: TiN, TiC, Ti(C,O), and (Ti,Al) (C,O).

12. The cutting tool insert according to claim 1, further comprising a top TiN-layer.

13. The cutting tool insert according to claim 1, wherein the body comprises 9.9–10.5 wt-% Co and 1.2–1.8 wt-% TaC+NbC.

14. The cutting tool insert according to claim 1, comprising an S-value of 0.85–0.89.

15. The cutting tool insert according to claim 1, further comprising an inner 2–8 μm layer of MTCVD Ti(C,N) between the multi-layer coating and the body.

16. The cutting tool insert according to claim 15, wherein the MTCVD layer is interposed between the cemented carbide body and the multi-layer coating.

17. The cutting tool insert according to claim 1, wherein the cemented carbide body comprises an S-value of 0.85–0.89.

* * * * *